US009770094B1

(12) United States Patent
Gresham

(10) Patent No.: US 9,770,094 B1
(45) Date of Patent: Sep. 26, 2017

(54) MULTI-PURPOSE FLOOR CLEANING DEVICE

(71) Applicant: Marilyn Gaye Gresham, Springtown, TX (US)

(72) Inventor: Marilyn Gaye Gresham, Springtown, TX (US)

( * ) Notice: Subject to any disclaimer, the term of this patent is extended or adjusted under 35 U.S.C. 154(b) by 9 days.

(21) Appl. No.: 15/098,593

(22) Filed: Apr. 14, 2016

Related U.S. Application Data

(60) Provisional application No. 62/164,701, filed on May 21, 2015.

(51) Int. Cl.

| | |
|---|---|
| ***A46B 15/00*** | (2006.01) |
| ***A47L 13/12*** | (2006.01) |
| ***A47L 13/08*** | (2006.01) |
| ***A47L 13/022*** | (2006.01) |
| ***A46B 17/08*** | (2006.01) |

(52) U.S. Cl.
CPC ..... *A46B 15/0081* (2013.01); *A46B 17/08* (2013.01); *A47L 13/022* (2013.01); *A47L 13/08* (2013.01); *A47L 13/12* (2013.01)

(58) Field of Classification Search
CPC ..... A46B 15/0081; A46B 17/00; A46B 17/08; A46B 2200/302; A46B 2200/3026; A46B 2200/3033; A47L 13/02; A47L 13/022; A47L 13/08; A47L 13/12
USPC ..... 15/105, 111, 236.01, 246; D4/118; D32/42, 46, 48–51
See application file for complete search history.

(56) References Cited

U.S. PATENT DOCUMENTS 412,002 A * 10/1889 Schroen ..... A47L 11/4038 15/111
688,160 A * 12/1901 Clarke ..... A47L 11/4038 15/111
746,428 A * 12/1903 Winne ..... A46B 15/0055 15/111
1,018,518 A * 2/1912 Pettit ..... A47L 11/4038 15/236.01
2,506,083 A * 5/1950 Hollander ..... A47L 13/08 30/169
2,719,316 A * 10/1955 Hauser ..... A47L 13/08 15/105
D239,480 S * 4/1976 Thomas ..... D4/118
3,947,913 A * 4/1976 Nelson ..... A46B 17/08 15/111
5,809,604 A * 9/1998 Olstyn ..... B25G 3/06 15/111
6,494,963 B1 * 12/2002 Holly ..... A47L 13/02 134/6

FOREIGN PATENT DOCUMENTS

DE 2602223 * 7/1977
DE 102004012376 * 9/2005
WO 95/29624 * 11/1995

* cited by examiner

*Primary Examiner* — Mark Spisich

(57) ABSTRACT

This invention relates to a hand held multi-purpose floor cleaning device having a sharp edged flat scraper for debris removal with an extended handle attachable to brooms, wet mops, sponge mops, dust mops, cleaning pads and similar devices to provide a method for removal of dried on or stuck on materials found on multiple type floors during cleaning.

6 Claims, 1 Drawing Sheet

MULTI-PURPOSE FLOOR CLEANING DEVICE

CROSS-REFERENCE TO RELATED APPLICATION

The present application claims priority from Provisional Patent application Ser. No. 62/164,701, filed May 21, 2015, entitled "MULTI-PURPOSE FLOOR CLEANING DEVICE.

BACKGROUND

A common problem found in connection with the use of brooms, wet mops, sponge mops, dust mops, cleaning pads and similar devices has been the limiting of the ability of the standard devices to remove debris that has hardened and stuck to the surface being cleaned. It is therefore desirable to remove all such debris which has accumulated prior to using standard sweeping or cleaning devices. While there have been attempts to accommodate this shortcoming, those methods have proved to be either unwieldy, ineffective, too complex or downright destructive to today's modern floor surfaces. To the end of safely removing said debris from the floor surfaces, one must to date still employ an additional device such as a commercial scraper or kitchen utensil of some type as well as the standard floor sweeping or cleaning devices.

Previous embodiments of separate hand-held scrapers or similar devices that can be used on typical household floors have been formed with short handles and require the use of two separate tools, both the scraper and a standard sweeping or cleaning device to do a complete job. The shortcomings of the common scraping tools lie in the fact that the handles of previous tools have been too short to comfortably use and require severe bending over or working by sitting on the floor. An additional shortcoming of the current method of cleaning the floor is that one must find the additional scraping tool needed that will not damage the floor in addition to a standard sweeping or cleaning device before beginning the cleaning task.

OBJECTS AND FEATURES OF THE INVENTION

It is therefore an object of this invention to provide a method wherein a combination of a sharp edged flat scraper which will be used for safely scraping and/or chipping away said debris or material stuck to the floor without damaging the floor on one end of the handle and a broom, wet mop, sponge mop, dust mop, cleaning pad and similar devices to safely finish the complete cleaning of the floor on the other end and eliminate the use of separate devices by creating one device to accommodate multiple needs. It's simple and effective use is achieved merely by flipping the multi-purpose floor cleaning tool 180 degrees (to use the opposite end) where the scraper is attached.

It is also the object of this invention to provide a method that while used in combination with standard floor cleaning tools, it is placed on the opposite end of the standard floor cleaning tool so as not to interfere with the intended function, maximum effectiveness or quality of that device.

Another object of this invention is to prevent having to keep track of two separate items to use or to use tools only marginally designed to do an adequate cleaning job on a floor surface. This device has an opening in the body that makes it easily hung into a storage space with a simple wall mounted hanger which makes it quickly accessible and ready for immediate use to conveniently accomplish both functions needed to completely clean the surface.

Other objects of this invention will in part be obvious and in part hereinafter pointed out. The invention accordingly consists in the features of construction, combinations of elements, and arrangement of parts, which will be exemplified in the construction hereinafter described, and of which the scope of invention will be indicated in the following claims.

SUMMARY OF THE INVENTION

The sharp edged flat scraper being attached to a broom, wet mop, sponge mop, dust mop, cleaning pad and similar device thereby forms a long handled scraper. In this way, the scraper may be used without undue inconvenience from having to look for an additional tool to safely remove debris or material stuck to the floor without damaging the floor or to bend over or sit on the floor in order to clean the floor and completely remove debris or material stuck to the floor by simply reversing the broom, wet mop, sponge mop, dust mop, cleaning pad and similar device and using the scraper end. The broad, sharp edge of the scraper is used to conveniently remove loose or easily removable debris or material stuck to the floor without damaging the floor surface material.

It will thus be seen that there is provided a device in which the several objects of this invention are achieved and which is well adapted to meet the conditions of practical use.

The device may be constructed with a variety of dimensions, shapes or of various types of materials ranging from PP (polypropylene) and various other composite materials to various types of metals to accommodate different types of applications from household cleaning to industrial floor cleaning. Upon reading this specification, those with ordinary skill in the art will now appreciate that, under appropriate circumstances, considering such issues as design preference, user preferences, marketing preferences, cost, structural requirements, available materials, technological advances, etc., other arrangements may suffice.

As various possible embodiments might be made of the above invention, and as various changes might be made in the embodiment above set forth, it is to be understood that all matter herein set forth or shown in the accompanying drawings is to be interpreted as illustrative and not in a limiting sense.

From the preceding description, it can be seen that the tool of the present invention allows for a more efficient, convenient, effective, user-friendly and economical cleaning process. It will also be safer to use than current methodology due to eliminating the need for being on your hands and knees on the floor or extreme bending over to reach debris needing to be removed. Although the invention has been described with reference to the preferred embodiment illustrated in the attached drawings, it is noted that equivalents may be employed and substitutions made herein without departing from the scope of the invention as recited in the claims.

BRIEF DESCRIPTION OF THE DRAWINGS

The accompanying drawings show various illustrative embodiments of this invention.

Item 1 being the sleeve in which the extended handle of the broom, wet mop, sponge mop, dust mop, cleaning pad and similar device is inserted;

Item 2 being the head portion of the scraper device;

Item 3 being the hole where a wall mounted hanger can fit through to allow it to be hung in storage;

Item 4 being the handle of the broom, wet mop, sponge mop, dust mop, cleaning pad and similar devices the scraper may be attached to.

Figure 2:
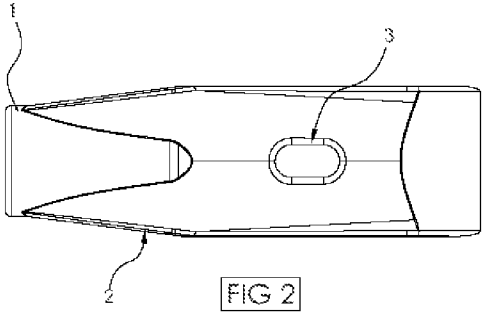

FIG. 2 is a top view of scraper device;

Item 1 being the sleeve in which the extended handle of the brooms, wet mops, sponge mops, dust mops, cleaning pads and similar devices is inserted;

Item 2 being the head portion of the scraper device;

Item 3 being the hole where a wall mounted hanger can fit through to allow it to be hung in storage.

Figure 1:
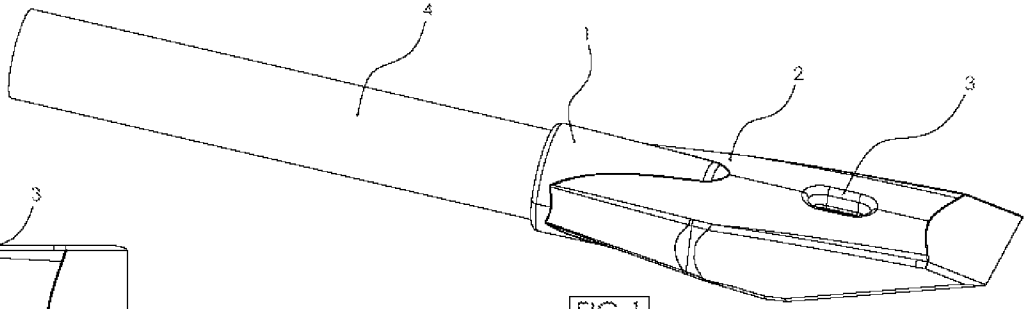
FIG. 1 is an isometric plan view of the assembled device embodying the invention.
Figure 3:
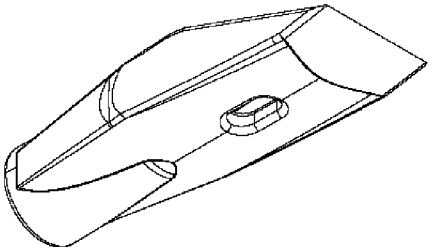
Figure 4:
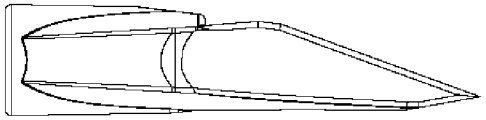
Figure 5:
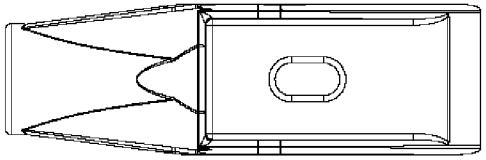

FIG. 3 is an isometric plan view of the body of the sharp edged flat scraping device;

FIG. 4 is a side plan view of the scraper device and showing the contour of the scraping edge;

FIG. 5 is a bottom view of the scraper device and showing the contour of the scraping edge;

Referring now in detail to the drawings, the completely assembled device comprises two main sections; a scraper and an extended handle as shown in FIG. 1. The scraper is formed with a head portion, Item 2, and an elongated straight handle portion, Item 4. The head portion, Item 2, has a wide, flat forward edge surface which slopes forward at an angle to form a sharp edge. The head portion, Item 2, tapers and narrows towards the sleeve, Item 1, at the point where the head portion, Item 2, meets the handle, Item 4. The head portion, Item 2, is inclined slightly upwardly from the sleeve, Item 1, as shown in FIG. 4 so that the head can rest flat against a surface being scraped while the handle is at an angle to said surface to permit ease in grasping the handle and to afford space for the handle to lie between the surface being scraped and the handle. The sleeve, Item 1, is of uniform width and extends from the head portion, Item 2, to allow for any predetermined length handle to be joined with it.

Having thus described my invention, I claim as new and desire to secure by Patent:

1. A floor scraping device adapted for attachment to a cleaning device, the cleaning device comprising an elongate handle having a first end to which a cleaning member is secured and an opposite second free end, the floor scraping device comprising:

a scraper body comprising a sleeve in which the second end of the elongate handle is adapted to the secured;

a head portion extending from the sleeve, the head portion defining a scraping edge, the scraping edge being defined by a pair of beveled surfaces comprising a planar major surface and a minor planar surface smaller in area than the major surface, the plane of the major surface extending across the longitudinal axis of the elongate handle when the scraping device is mounted thereon; and wherein the major and minor surfaces define a sharp scraping edge laterally offset with respect to the longitudinal axis.

2. The scraping device of claim 1, wherein the cleaning member is one of a broom, a wet mop, a sponge mop, a dust mop and a cleaning pad.

3. The scraping device of claim 1, wherein the head portion includes a hole for hanging on a support when not in use.

4. The scraping device of claim 1, wherein it is made of a plastic.

5. The scraping device of claim 4, wherein the plastic is polypropylene.

6. The scraping device of claim 1, wherein it is made of a metal.

* * * * *